United States Patent [19]

Ladduwahetty

[11] Patent Number: 4,831,796

[45] Date of Patent: May 23, 1989

[54] STRUCTURAL SUPPORT INSERT FOR USE WITH CONCRETE

[76] Inventor: Neville S. Ladduwahetty, 1 Melody La., Cherry Hill, N.J. 00802

[21] Appl. No.: 116,588

[22] Filed: Nov. 3, 1987

[51] Int. Cl.[4] ..... E04B 1/41

[52] U.S. Cl. ..... 52/125.5; 52/704

[58] Field of Search ..... 52/699–711, 52/125.5

[56] References Cited

U.S. PATENT DOCUMENTS

| | | | |
|---|---|---|---|
| 1,088,290 | 2/1914 | McAllister et al. | 52/707 |
| 1,122,470 | 12/1914 | Brussel | 52/707 |
| 1,708,091 | 4/1928 | Healy | 52/709 |
| 1,769,498 | 7/1930 | Downing | 52/699 |

FOREIGN PATENT DOCUMENTS

| | | | |
|---|---|---|---|
| 981287 | 1/1951 | France | 52/707 |
| 317795 | 1/1957 | Switzerland | 52/700 |

*Primary Examiner*—James L. Ridgill, Jr.

*Attorney, Agent, or Firm*—Foley & Lardner, Schwartz, Jeffery, Schwaab, Mack, Blumenthal & Evans

[57] ABSTRACT

A structural support insert to be imbedded in a body of concrete. The insert has a main body including a first axially extending opening formed therethrough from a first end to a second end, and having first and second elongated slots formed therein. The slots extend along axes substantially parallel to the first opening. The first slot defines a second opening between a first outer surface of the main body and a first inner surface of the first opening. The second slot is defined in a second inner surface of the first opening, opposite the first inner surface. A plurality of lugs are connected to opposed second and third outer surfaces of the main body. The first outer surface of the main body is substantially flush with a surface of the concrete body, whereby the first slot defines an opening in the concrete body.

12 Claims, 2 Drawing Sheets

FIG. 1
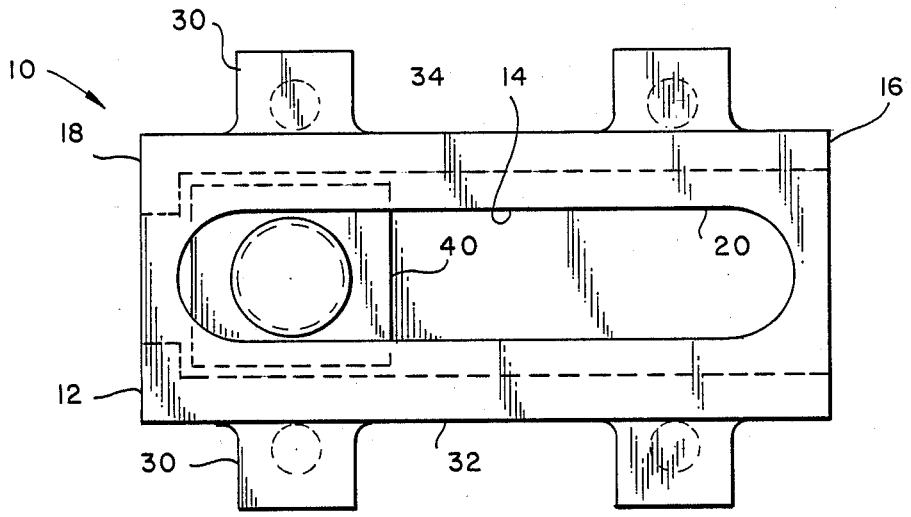
FIG. 2
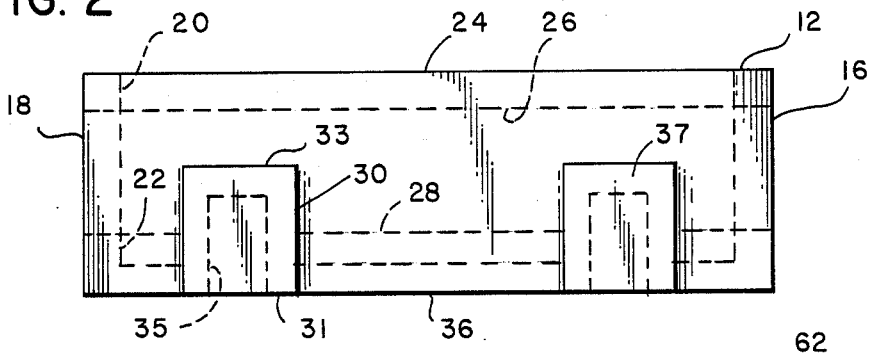
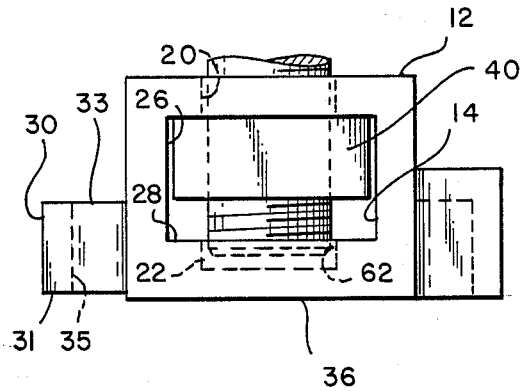
FIG.3
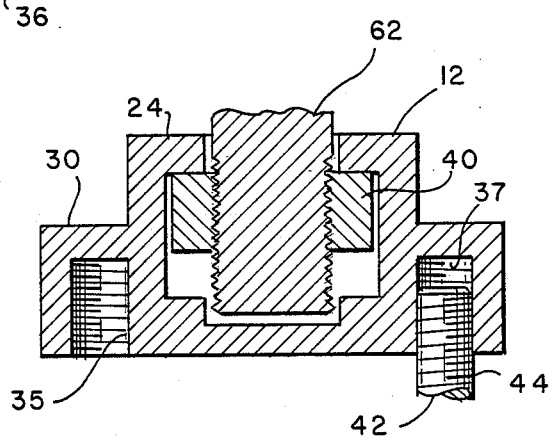
FIG. 4

STRUCTURAL SUPPORT INSERT FOR USE WITH CONCRETE

BACKGROUND OF THE INVENTION

1. Field of the Invention

This invention relates generally to structures and more particularly to a structural support insert for use with concrete whereby the insert is retained in a hardened body of concrete and provides an attachment base for a stuctural element such as a precast concrete member or a structual steel member.

2. Background Description

Structural support inserts in general, are accessories which are cast into a body of concrete, such as a wall, thus providing an anchorage device for attaching precast concrete elements or structural steel elements thereto. Alternatively, structural support inserts may be cast into the body of the precast concrete elements thus providing an anchorage device that enables the precast elements to be attached to the main support system of a structure. Such inserts are required to be capable of resisting gravity, wind, seismic, thermal and erection forces that the precast or structural steel members are subjected to.

While most of these forces can be quantified, erection forces cannot be established or controlled with any degree of accuracy. In view of such limitations, inserts currently in use may be subjected to forces exceeding the safe working loads specified by insert manufacturers. Furthermore, inserts often fail in a brittle manner with minimum warning due to the failure of the concrete body immediately surrounding the insert.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a structural support insert for use with concrete including a main body portion of the insert having a first axially extending opening formed therethrough from a first end to a second end. First and second elongated slots are formed in the insert. The slots extend in along axes substantially parallel to the axially extending opening. The first slot defines a second opening between a first outer surface of the main body and a first inner surface of the first opening. The second slot is defined in a second inner surface of the first opening, opposite the first inner surface. A plurality of lugs are connected to opposed second and third outer surfaces of the main body.

The foregoing and other aspects will become apparent from the following detailed description of the invention when considered in conjunction with the accompanying drawing. It is to be expressly understood, however, that the drawing is not intended as a definition of the invention but is for the purpose of illustration only.

BRIEF DESCRIPTION OF THE DRAWING

In the drawing:

FIG. 1 is a plan view illustrating an embodiment of the insert of the present invention;

FIG. 2 is a side elevational view of the insert of FIG. 1;

FIG. 3 is an end view of the insert illustrating a nut retaining a threaded member in the insert;

FIG. 4 is a cross sectional view of the insert illustrating a nut retaining a threaded member in the insert and a threaded rod received in a lug;

DETAILED DESCRIPTION

Figure 5:
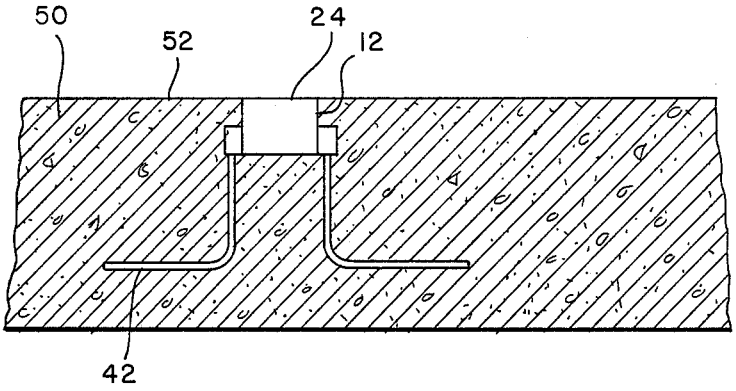
FIG. 5 is a view of the insert embedded in a portion of a concrete wall.
Figure 6:
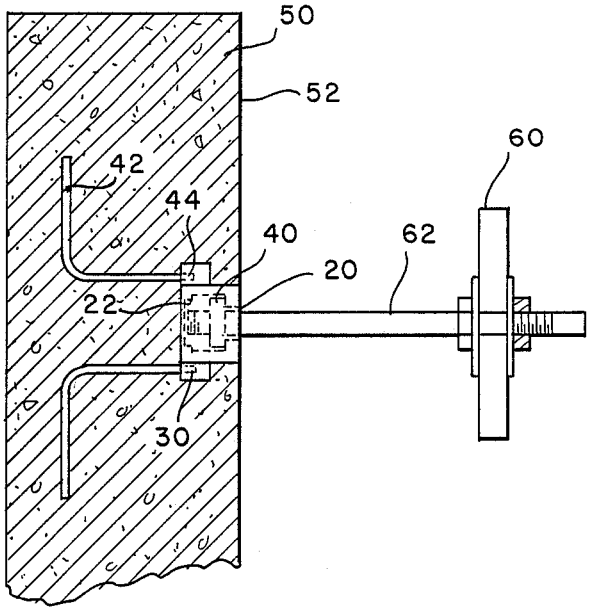
FIG. 6 is another view of the insert embedded in a portion of a concrete wall having a structural member attached thereto.

In FIGS. 1–6, a structural support insert is generally designated 10 and includes a main body portion 12 preferably formed by a casting of metal meeting ASTM A47 requirements for Grade 32510. A first axially extending opening 14 is formed through main body portion 12 from a first end 16 to a second end 18. Opening 14 is relatively larger at first end 16 than at second end 18.

An aligned pair of first and second slots 20, 22, respectively, are formed in main body 12 and extend along axes substantially parallel to the axis of first opening 14. First slot 20 defines a second opening between a first outer surface 24 of main body 12 and a first inner surface 26 of first opening 14. Second slot 22 is defined in a second inner surface 28 of first opening 14, opposite first inner surface 26.

A plurality of lugs 30 are connected to opposed second and third outer surfaces, 32, 34, respectively, of main body 12. The lugs 30 extend from an end 31 adjacent a fourth outer surface 36 of main body 12 along outer surfaces 32, 34 toward first outer surface 24 and terminate at an end 33 thereof. A blind threaded bore 35 is provided in each of the lugs 30. Bore 35 extends from end 31 of lug 30 and terminates at a seat 37. Alternatively, lugs 30 may be modified so that end 31 is recessed from fourth outer surface 36. Also, if desired, threaded bore 35 may extend through lug 30 from end 31 to end 33, see FIG. 3, which provides an example of such a modification to one of the lugs 30.

A threaded nut 40 is slidably mounted for movement within first opening 14 adjacent first slot 20. Anchoring rods 42 have threaded ends 44 received in bores 35. Rods 42 are bent to any desired shape. Typically a right angle bend is sufficient. Rods 42 meet ASTM A307.

Insert 10 may be mounted in a concrete body 50 having a surface 52. Insert 10 is placed during forming of the concrete body 50 so that rods 42 extend from lugs 30 forming anchorages within concrete body 50 such that first outer surface 24 of main body 12 is substantially flush with surface 52 of concrete body 50. As a result, when the concrete body cures, insert 10 is securely anchored therein, first slot 20 defines an opening in surface 52 of concrete body 50, and nut 40 is slideable along slot 20 within first opening 14. Duct tape, or the like, may be used to cover ends 16, 18 to limit wet concrete from entering opening 14.

When a structural member 60 is to be attached to concrete body 50, a bolt or threaded rod 62 also meeting ASTM A307, is attached to member 60 and to nut 40. Second slot 22 provides a recess for bolt or rod 62. The elongation of slots 20, 22 provide a built-in tolerance between insert 10 and bolt or rod 62. Nut 40 bears against first inner surface 26.

The positive anchorage provided by rods 42 attached to insert 10, resists much higher forces than conventional inserts by increasing the effective area of concrete supporting structural member 60 resulting in the ability of insert 10 to resist much higher forces imposed by structural member 60.

What is claimed is:

1. A structural support insert for use with concrete comprising:

a main body having a first axially extending opening formed therethrough from a first open end to a second open end, said first open end being of a construction sufficient to admit a member to be slidably mounted in said first opening and said second open end being of a construction sufficient to limit sliding of said member, said main body having first and second elongated slots of uniform width formed therein, said slots extending along axes substantially parallel to said first opening, said first slot defining a second opening between a first outer surface of said main body and a first inner surface of said first opening, said second slot being defined in a second inner surface of said first opening, opposite said first inner surface, and a plurality of lugs connected to opposed second and third outer surfaces of said main body.

2. The structural support insert of claim 1, wherein said member is a threaded nut slidably mounted in said first opening.

3. The structural support insert of claim 1, wherein said lugs each have a threaded opening formed therein.

4. The structural support insert of claim 1, including:

an anchor member connected to each lug and extending therefrom.

5. The structural support insert of claim 4, wherein each of said anchor members has a threaded end connected to a respective lug.

6. The structural support insert of claim 4, wherein each anchor member is bent.

7. The structural support insert of claim 6, wherein said member is a threaded nut slidably mounted in said first opening.

8. The structural support insert mounted in a concrete body comprising:

a main body of said insert having a first axially extending opening formed therethrough from a first open end to a second open end, said first open end being of a construction sufficient to admit a member to be slidably mounted in said first opening and said second open end being of a construction sufficient to limit sliding of said member, said main body having first and second elongated slots of uniform width formed therein, said slots extending along axes substantially parallel to said first opening, said first slot defining a second opening between a first outer surface of said body and a first inner surface of said first opening, said second slot being defined in a second inner surface of said first opening, opposite said first inner surface, a plurality of lugs connected to opposed second and third outer surfaces of said main body, and said first outer surface of said main body being substantially flush with a surface of said concrete body, whereby said first slot defines an opening in said concrete body.

9. The structural support insert of claim 8, including:

an anchor member connected to each lug and extending therefrom into said concrete body.

10. The structural insert of claim 9, wherein each anchor member is bent.

11. The structural support insert of claim 10, wherein said member is a threaded nut slidably mounted in a said first opening.

12. The structural support insert of claim 11, including:

a structural member extending through said second opening and connected to said nut.

* * * * *